US006749355B2

(12) United States Patent
Payne et al.

(10) Patent No.: US 6,749,355 B2
(45) Date of Patent: Jun. 15, 2004

(54) WRITING INSTRUMENT WITH USER-CONTROLLED INK COLOR

(75) Inventors: David M. Payne, Star, ID (US); Tim M. Hoberock, Boise, ID (US); C. Troy Jensen, Caldwell, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/056,655

(22) Filed: Jan. 24, 2002

(65) Prior Publication Data

US 2003/0138282 A1 Jul. 24, 2003

(51) Int. Cl.[7] ..... B43K 29/00

(52) U.S. Cl. ..... 401/195; 401/46; 347/109

(58) Field of Search ..... 401/52, 195, 46; 346/140.1; 364/140.1; 347/109; 178/18

(56) References Cited

U.S. PATENT DOCUMENTS

| | | | | | |
|---|---|---|---|---|---|
| 4,748,460 | A | * | 5/1988 | Piatt et al. | 401/195 |
| 4,758,849 | A | * | 7/1988 | Piatt et al. | 401/195 |
| 5,501,535 | A | * | 3/1996 | Hastings et al. | 400/88 |
| 5,911,533 | A | * | 6/1999 | Fassler et al. | 401/195 |
| 5,939,702 | A | * | 8/1999 | Knighton et al. | 401/195 |
| 6,422,775 | B1 | * | 7/2002 | Bramlett et al. | 401/195 |
| 6,454,482 | B1 | * | 9/2002 | Silverbrook et al. | 346/140.1 |

* cited by examiner

*Primary Examiner*—Tuan N. Nguyen

(57) ABSTRACT

A writing instrument, e.g., a pen, incorporates at least three color ink chambers: cyan (C), yellow (Y), and magenta (M). The ink from the three chambers can be mixed in varying ratios to provide an output ink of any conceivable color. Ink jet nozzles, preferably thermal ink jet nozzles, are used to output the ink from the chambers. The ink may be output to a mixing chamber, onto a roller ball or other transfer member, or directly to the writing medium. Consequently, the ink output by the pen can be adjusted by the user to any desired color.

43 Claims, 7 Drawing Sheets

WRITING INSTRUMENT WITH USER-CONTROLLED INK COLOR

FIELD OF THE INVENTION

The present invention relates to the field of writing instruments, e.g., pens, markers, pencils, colored pencils, etc. In particular, the present invention relates to the field of writing instruments that write in a colored ink. The present invention provides a pen or writing instrument for which the user can control the color of the ink, i.e., the color in which the pen writes.

BACKGROUND OF THE INVENTION

Writing instruments have been important to mankind for millennia. Writing instruments allow people to record thoughts, events and ideas. Writing instruments allow people to draw diagrams, illustrate text and create works of art.

Modern writing instruments, including pens, pencils, markers, etc., that allow users to write and draw anything they can imagine. Traditionally, writing instruments have made a black or dark line on a white background, e.g., a piece of paper.

However, writing instruments can also make use of color. For example, pens may come in a variety of colors, such as black, blue, red or green. Markers and colored pencils often come in sets that include a marker or pencil for each major color in the spectrum.

The introduction of color in writing instruments has many uses. Written text can be rendered in several colors for emphasis or artistic reasons. Drawings can be prepared in color to convey additional information through the use of color or for aesthetic reasons. Text in one color can be edited in a second color so that the changes are easily identified.

Given the many uses of color in working with a writing instrument, it will be obvious that users would prefer to be able to readily choose the color written by their writing instrument. In the past, this has been accomplished, as indicated above, by providing a set of differently colored writing instruments: pens, markers or colored pencils; so that a user can select at will from the set and write in the desired color. This, however, requires the user to purchase and carry or store the complete set of writing instruments so as to be able to work in a range of colors.

As an alternative, there have been some pens that include several ink tubes with differently colored ink in each tube. By extending the writing end of a particular tube from the pen casing, the pen can be made to write in a particular color. The color of the pen is then changed by retracting that tube and extending another tube containing differently colored ink. In this way, a single writing instrument can be made to write in two or three or more different colors.

While such pens to provide multiple colors in a single writing instrument, the number of colors available is still limited. As more color options are added to such a pen, the fatter and bulkier the pen becomes. Consequently, there are likely to be far fewer colors available in such a pen than would be available if the writer were using a set of differently colored pens or markers.

Consequently, there is a need in the art for a writing instrument that, in a relatively compact package, provides users with a wide variety of different colors in which the instrument can write.

SUMMARY OF THE INVENTION

The present invention provides, among other things, a hand-held writing instrument for writing in a user-controlled color. The writing instrument preferably includes an ink cartridge with at least three ink chambers, each chamber for holding a different color ink; nozzles connected to the ink chambers for releasing ink from the chambers in a controlled ratio; and a processor connected to and controlling release of ink through the nozzles. The ink cartridge, ink jet nozzles and processor are all preferably incorporated into an elongated housing of the hand-held writing instrument.

A transfer member may be used for receiving ink from the nozzles and transferring the ink to a writing surface. Optionally, a mixing chamber may be used into which ink from the nozzles is released for mixing. If a mixing chamber is used, a sensor may be employed to sense ink in the mixing chamber and output a signal to the processor indicative of the amount of ink in the mixing chamber.

A color input interface may be included on the writing instrument through which a user can specify the output color for the writing instrument. The output color is then created by mixing ink from the ink chambers in the appropriate controlled ratio. In one embodiment, the color input interface may include three buttons, each button corresponding to one of the ink chambers and a color of ink contained therein.

Additionally or alternatively, the writing instrument may employ a scanner, connected to the processor, for sampling a color and outputting to the processor a specified ratio of three basic color components making up the sampled color. The processor then uses the specified ratio as the controlled ratio for releasing ink from the ink chambers to duplicate the sampled color with the writing instrument.

Additionally or alternatively, the writing instrument may include an interface between the writing instrument and a host electronic device for receiving from the host device a specification of the controlled ratio, i.e., the desired output color. This interface may be, for example, a radio frequency wireless interface, an infrared wireless interface or a wired interface. The host device may be, for example, a computer or a personal digital assistant.

The present invention also encompasses the method of making and using the above-described writing instrument. For example, the present invention encompasses a method of controlling the output color of a hand-held writing instrument by mixing differently colored inks from three ink chambers within an elongated housing of the hand-held writing instrument, the inks being mixed in a controlled ratio to prepare an output ink of the desired output color.

BRIEF DESCRIPTION OF THE DRAWINGS

The accompanying drawings illustrate preferred embodiments of the present invention and are a part of the specification. Together with the following description, the drawings demonstrate and explain the principles of the present invention.

Throughout the drawings, identical elements are designated by identical reference numbers.

DETAILED DESCRIPTION OF THE PREFERRED EMBODIMENTS

The present invention provides a writing instrument, e.g., a pen, that incorporates three color ink chambers: cyan (C), yellow (Y), and magenta (M). The ink from the three chambers can be mixed in varying ratios to provide an output ink of any conceivable color. Ink jet nozzles, preferably thermal ink jet nozzles, are used to output the ink from the chambers. The ink may be output to a mixing chamber, onto a roller ball or other transfer member, or directly to the writing medium. Consequently, the ink output by the pen can be adjusted by the user to any desired color.

Using the drawings, the preferred embodiments of the present invention will now be explained.

Figure 1:
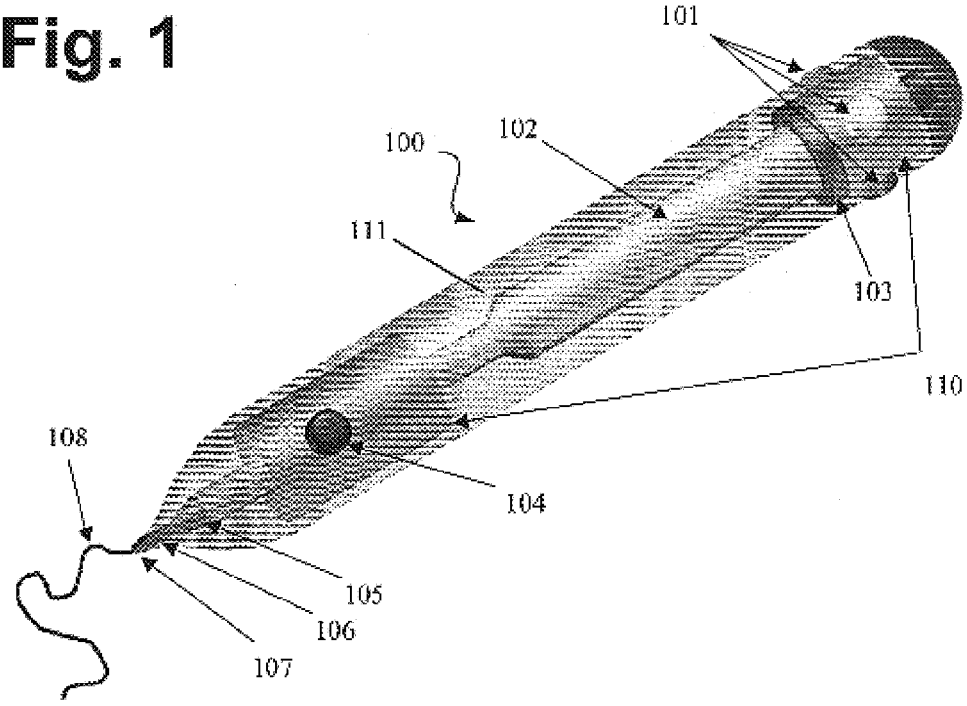
FIG. 1 is an illustration of a preferred embodiment of a writing instrument according to the principles of the present invention.

FIG. 1 illustrates a first preferred embodiment of a writing instrument according to the present invention. As shown in FIG. 1, the present invention may be embodied in a pen (100) or other writing instrument for which the user can control the color of the ink (108) output by the instrument.

The pen (100) incorporates at least three, color ink chambers (102), preferably in a generally cylindrical housing (111). The ink chambers (102) each contain ink of a different color. Preferably, one chamber contains magenta ink, one chamber contains yellow ink and the third contains cyan ink. The inks from these three chambers can be mixed in different ratios to create ink of any conceivable color.

The chambers (102) are preferably integrated into a removable cartridge that can be replaced or refilled when empty. More preferably, each chamber (102, See FIG. 2) can be individually replaced or refilled, as one color may tend to get used much more than the others.

Each of the chambers (102) is connected to an ink jet nozzle or nozzle array (105). These are preferably thermal ink jet nozzles (105) that eject ink in controlled quantities by heating the ink to cause expansion and emission of the ink.

The ink for all of the chambers (102) may be ejected into a mixing chamber (106). The inks are mixed in the mixing chamber (106) in the ratio required to obtain ink of the target color.

A transfer element (107) may then be used to transfer the mixed ink from the chamber (106) to the writing surface. The transfer element (107) may be, for example, a ball as in a ballpoint pen. The transfer element (107) could also be a porous element, e.g., a sponge or felt tip that absorbs the ink from the mixing chamber (106) and then releases the ink to the writing surface under pressure from the user. It would likely be easier to switch between color mixtures using a ball rather than a porous transfer element. However, any transfer element is within the scope of the present invention.

A battery (103) provides power for the ink jet nozzles (105) and for the electronics of the pen (100). The electronics or circuitry (110) control the color of the mixed ink issuing from the pen (100).

Preferably near the top of the pen (100), is a user input device (101) supported by the electronics (110). With the user input device (101), the user can control the color of the mixed ink issuing from the pen (100).

In the illustrated embodiment, this user input device (101) consists of three buttons each of which, when actuated, alters the ratio of one of the three color components in the mixed ink. For example, if the user desires the color from the pen (100) to be more blue, the user would actuate the "blue" button, i.e., the button corresponding to the cyan ink in the ink cartridge (102). The ratio of cyan ink being added to the mixture in the mixing chamber (106) would then be increased.

The ratio or amount of each color of ink released to the mixing chamber (106) is controlled by further electronics (110) that are located near the ink jet nozzles (105) and drive the nozzles (105) in accordance with the desired color for the output ink (108). The electronics supporting the user input device communicate with the electronics driving the ink jet nozzles to provide the desired color for the output ink (108).

A reset button (104) is preferably provided as part of the pen's electronics (110). When the reset button (104) is actuated, the color being output by the pen is reset to a default, for example, black or blue.

Figure 2:
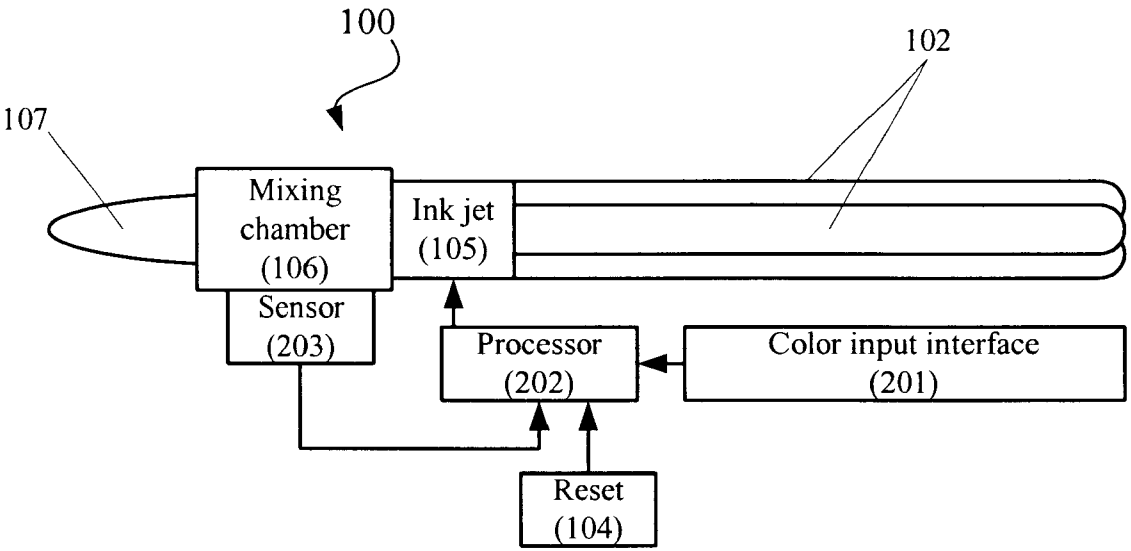
FIG. 2 is a schematic diagram of the writing instrument illustrated in FIG. 1.

FIG. 2 illustrates the interior components of the pen (100), particularly the electronics, in greater detail. As shown in FIG. 2, at least three chambers of ink are combined into an ink cartridge (102) for the pen shown in FIG. 1. Ink jet nozzles (105) release ink from these chambers (102) in a controlled manner to a mixing chamber (106) as described above.

A processor (202) controls the ink jet nozzles (105). The processor (202) receives input from a color input interface (201) that defines the color to be output by the writing instrument. The color input interface (201) can be the three-button user interface illustrated and described in FIG. 1 or any other input device that allows a user to control the color of the output ink (108). For example, the color input device (201) could comprise a small display (205) providing a numeric or percentage indication of the amount of ink of each color being contributed to the mixed output ink (108) and a dial, buttons, knob or other device for selecting and adjusting the ratio of each color component of the output ink (108).

A sensor (203) may be provided in the mixing chamber (106) to monitor the level of ink in the mixing chamber (106) to ensure that an optimal level for writing is maintained. The sensor (203) signals the processor (202) which can then increase or decrease the flow of ink through the jets (105) accordingly.

Finally, the processor (202) also receives a signal from the reset switch (104) upon actuation thereof. This signal causes the processor (202) to reset the ratio of inks being released into the mixing chamber (106) to provide a default color, e.g., black or blue. The processor (202) then maintains this default color until new input is received from the color input interface (201) specifying the parameters for a new mixture, i.e., a new color.

Figure 3:
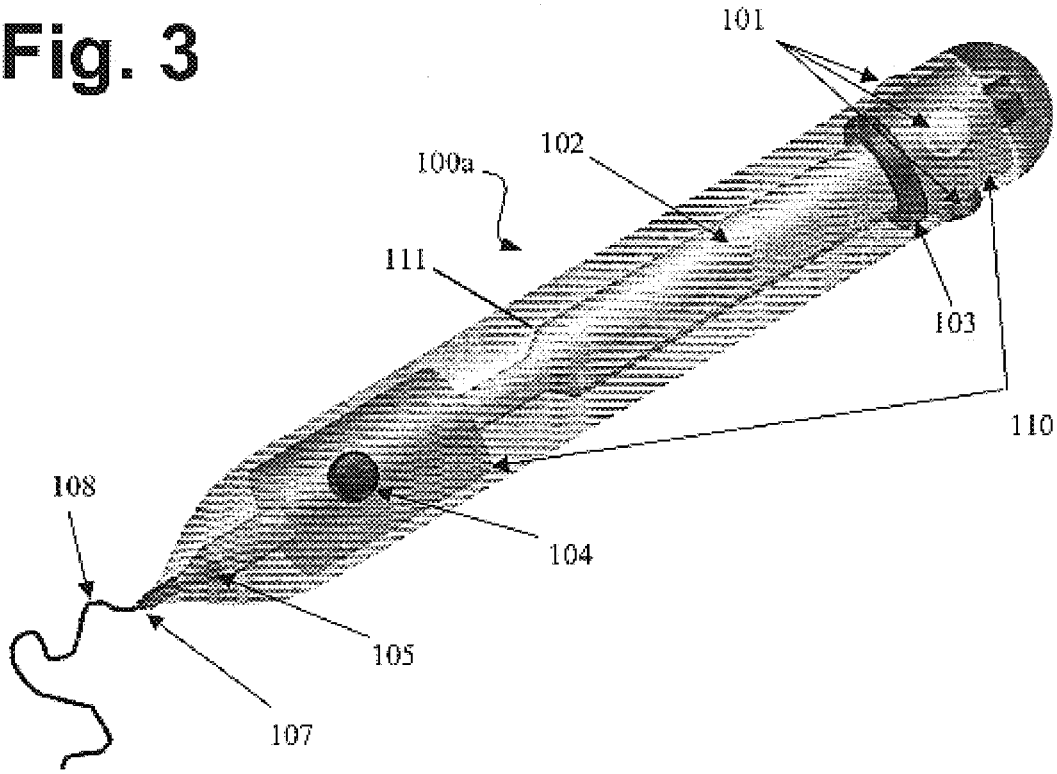
FIG. 3 is an illustration of a second preferred embodiment of a writing instrument according to the principles of the present invention.

FIG. 3 illustrates a second exemplary embodiment of a writing instrument according to the present invention. The embodiment of FIG. 3 is substantially similar in many respects to the embodiment of FIG. 1. Consequently, a redundant explanation of identical or substantially identical components will be omitted.

As shown in FIG. 3, the mixing chamber (106; FIG. 1) can be omitted. The ink jet nozzles (105) can fire directly onto the transfer member (107), e.g., a ballpoint. The ink is then mixed as transferred by the transfer member (107) to the writing surface. The result is the desired output ink (108).

While this embodiment spares the expense of incorporating a mixing chamber, it will also be understood that the resulting output ink (108) may not be mixed as well or flow as smoothly as would be the case if a mixing chamber where used, as in the embodiment of FIG. 1.

Additionally, in a third embodiment that is not specifically illustrated, the transfer member (107) could also be omitted. The ink jet nozzles (105) can be made to fire directly onto the writing surface, the output ink (108) being mixed directly on the writing surface. Again, such an embodiment would spare the cost of both a mixing chamber and transfer member, but may also loose mixture quality and decrease the smoothness of the ink flow as a result.

Figure 4:
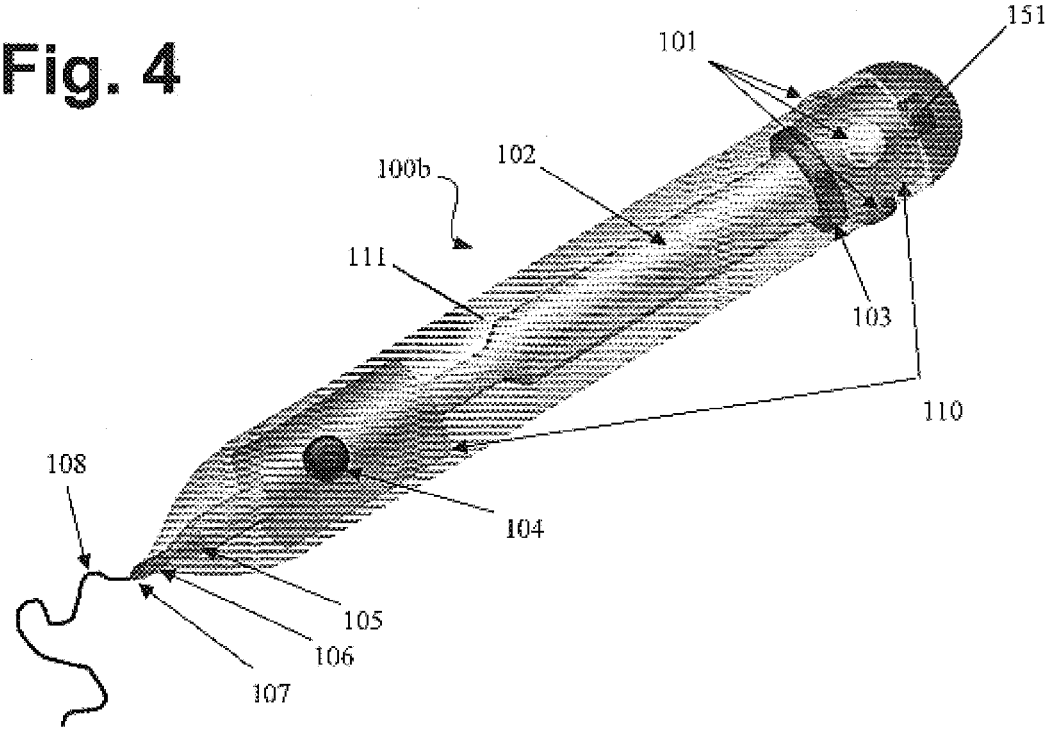
FIG. 4 is an illustration of a third preferred embodiment of a writing instrument with a color sample scanner according to the principles of the present invention.

FIG. 4 illustrates a fourth exemplary embodiment of a writing instrument according to the present invention. Again, the embodiment of FIG. 4 is substantially similar in many respects to the embodiments of FIGS. 1 and 3. Consequently, a redundant explanation of identical or substantially identical components will be omitted.

The embodiment of FIG. 4 adds an additional means of inputting the desired color of the output ink (108). The embodiment of FIG. 4 incorporates a scanner (151). This scanner (151) is preferably a three element Charge Coupled Device (CCD) array. Each of the three elements detects photons of a particular wavelength, i.e., color.

Thus, when the scanner (151) scans a color, the three elements of the CCD array will output signals indicative of the ratio of each of the three primary colors in the scanned color. Consequently, the pen (100*b*) can be programmed to duplicate those ratios of the three colored inks in the cartridge (102) to reproduce the color scanned by the scanner (151).

Consequently, the user can sample a color with the scanner (151) from any object at hand. The pen (100*b*) will then write in that sampled color. This may be easier and less time consuming that programming in the color the user desired through the user input device (101) of previous embodiments. However, the user input device (101) can also be incorporated in the pen (100*b*) with the scanner (151) as shown in FIG. 4. In this way, the user can still dial in a desired color even if a sample of the desired color is not at hand for scanning.

Figure 5:
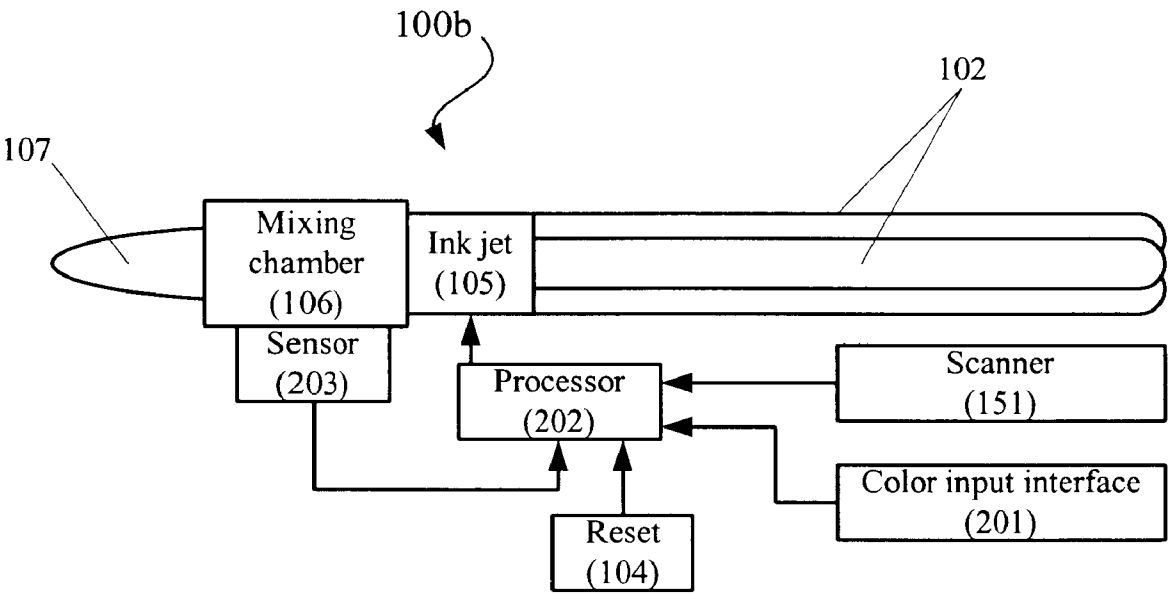
FIG. 5 is a schematic diagram of the writing instrument illustrated in FIG. 4.

FIG. 5 illustrates in greater detail the electronics and interior components of the pen (100*b*) with the scanner (151). As shown in FIG. 5, the output of the scanner (151) is fed to the processor (202). The processor (202) uses the output of the scanner (151) to determine the ratio of each of the three basic color components in the sampled color. The processor (202) then controls the ink jet nozzles (105) appropriately to reproduce the sampled color in the output ink.

Additionally, the scanned color being duplicated can always be reset by actuation of the reset (104). In all embodiments, the reset (104) may be a button, key, switch or the like. After a reset, a new color can be scanned with the scanner (151) or a custom color can be input using the color input interface (201) as described above.

Figure 6:
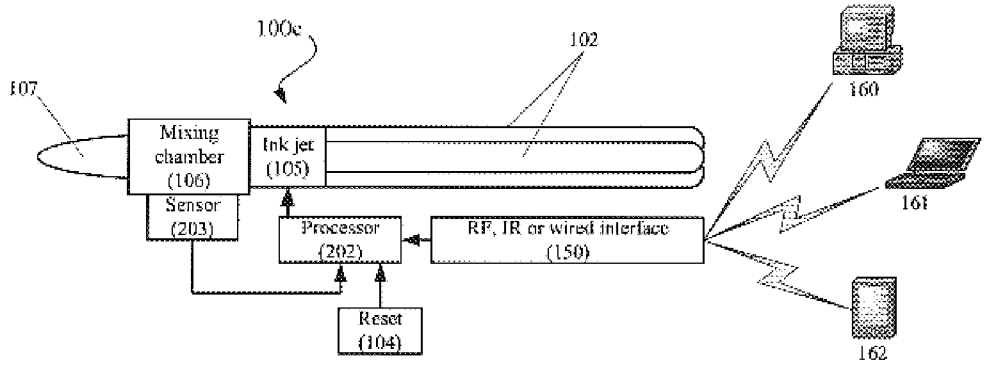
FIG. 6 is a schematic diagram of fourth preferred embodiment of a writing instrument with an interface to another electronic device according to the principles of the present invention.

FIG. 6 illustrates a fifth exemplary embodiment of a writing instrument according to the present invention. Again, the embodiment of FIG. 6 is substantially similar in many respects to the previously described embodiments. Consequently, a redundant explanation of identical or substantially identical components will be omitted.

As shown in FIG. 6, the writing instrument (101*c*) according to the present invention may have an interface (150) that allows it to interface with another electronic host device. The host device may be, for example, a computer or computer terminal (160), a laptop (161) or a personal digital assistant (PDA) or palmtop computer (162) or other electronic device, such as a scanner.

A custom color with which the pen (101*c*) is to write can be defined using the user interface and software of the host device (e.g., 160, 161 or 162). This custom color is then communicated to the pen (101*c*) through the interface (150) for the pen (101*c*) to reproduce.

The interface (150) can be, for example, a radio frequency (RF) wireless interface, an infrared (IR) wireless interface or a wired interface. Many laptops and PDAs currently incorporate an IR transceiver for transmitting digital data. Thus, it would be relatively easy to include an IR transceiver in the pen (101*c*) for receiving color-defining data from a host device (e.g., 160, 161 or 162).

With a wired interface, a wire or cable could be connected from the host device (e.g., 160, 161 or 162) to the pen (101*c*). This wire could be a non-standard cable designed particularly for communication between the pen (101*c*) and the host device. Alternatively, the wire could be a standard cable such as a Universal Serial Bus (USB), an IEEE 1394 bus (a.k.a, a Firewire) or other standard connection between electronic devices.

The processor (202) will receive input from the host device (e.g., 160, 161 or 162) through the interface (150). This input will define the desired color of the output ink. The processor (202) will then control the ink jet nozzles (105) accordingly to produce ink of the specified color.

Figure 7:
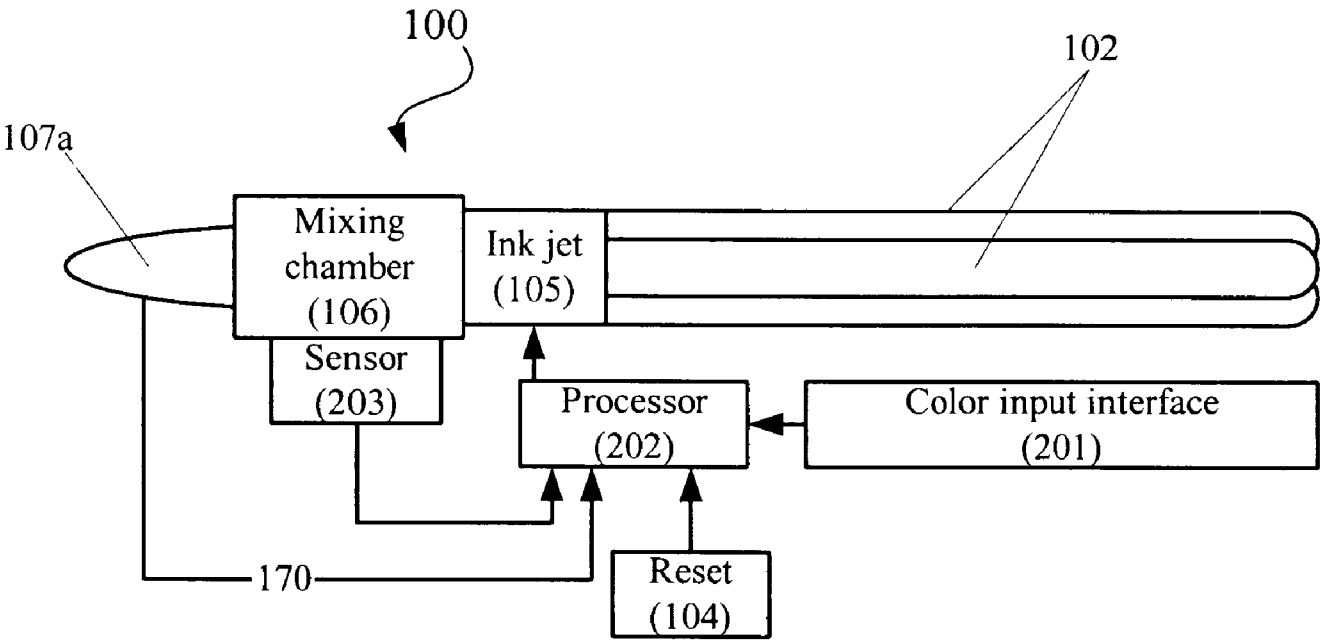
FIG. 7 is a schematic diagram of a writing instrument according to the present invention with a pressure-sensitive tip.

FIG. 7 illustrates a feature of the present invention which may be implemented in any of the preceding and any other embodiment of the present invention. A shown in FIG. 7, the tip of the writing instrument incorporates a pressure-sensitive tip (107*a*). The pressure sensor (107*a*) sends a signal (170) to the processor (202). The processor (202) will not drive the ink jet nozzles (105) to disperse any ink unless the pressure signal (170) from the pressure-sensitive tip (107*a*) indicates a minimum pressure on the tip (107*a*). Thus, pressure on the tip (107*a*) above a minimum threshold, which threshold can be determined according to design preferences, is required before the writing instrument (100) begins releasing ink.

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A hand-held writing instrument for writing in a user-controlled color, said writing instrument comprising:

an ink cartridge comprising a plurality of ink chambers, each chamber for holding a different color ink;

nozzles connected to said ink chambers for releasing ink from said chambers in a controlled ratio;

a mixing chamber connected to said nozzles for receiving ink from said nozzles;

a processor operatively connected to said nozzles for controlling the release of ink through said nozzles;

wherein said ink cartridge, nozzles and processor are all incorporated into an elongated housing of said hand-held writing instrument; and a color input interface through which a user can specify an output color for said writing instrument, said output color being created by mixing ink from said ink chambers in said controlled ratio;

wherein said color input interface comprises three buttons, each button corresponding to one of the ink chambers and a color of ink contained therein.

2. The writing instrument of claim 1, wherein said ink cartridge comprises at least three ink chambers.

3. The writing instrument of claim 1, further comprising a pressure-sensitive tip on said writing instrument, said pressure-sensitive tip operatively connected to said processor such that said processor can control said nozzles to prevent release of ink unless pressure on said tip above a predetermined threshold is signaled by said pressure-sensitive tip.

4. The writing instrument of claim 1, further comprising a transfer member for receiving ink from said nozzles and transferring said ink to a writing surface.

5. The writing instrument of claim 4, wherein said transfer member comprises a ball.

6. The writing instrument of claim 1, further comprising a sensor for sensing ink in said mixing chamber and outputting a signal to said processor indicative of an amount of ink in said mixing chamber.

7. The writing instrument of claim 1, further comprising a reset, connected to said processor, for resetting said controlled ratio to a default ratio.

8. The writing instrument of claim 1, further comprising a scanner, connected to said processor, for sampling a color and outputting to said processor a specified ratio of three basic color components making up said sampled color, wherein said processor is configured to use said specified ratio as said controlled ratio for releasing ink from said chambers to duplicate said sampled color with said writing instrument.

9. The writing instrument of claim of claim 8, wherein said scanner comprises a three-element CCD array, each element of said array being configured to measure a basic color component in said sampled color.

10. The writing instrument of claim 1, further comprising an interface for connecting said writing instrument to a host electronic device for receiving from said host device a specification of said controlled ratio.

11. The writing instrument of claim 10, wherein said interface is a radio frequency wireless interface.

12. The writing instrument of claim 10, wherein said interface is an infrared wireless interface.

13. The writing instrument of claim 10, wherein said interface is a wired interface.

14. The writing instrument of claim 10, wherein said host device is a computer.

15. The writing instrument of claim 10, wherein said host device is a personal digital assistant.

16. A method of controlling the output color of a hand-held writing instrument, said method comprising, within an elongated housing of said hand-held writing instrument, mixing differently colored inks from at least three ink chambers in a controlled ratio in a mixing chamber to prepare an output ink of said output color, and specifying said output color by transmitting data defining said output color to said writing instrument from a color input interface, said output color being created by mixing ink from said ink chambers in said controlled ratio, wherein said color input interface comprises three buttons, each button corresponding to one of the ink chambers and a color of ink contained therein.

17. The method of claim 16, further comprising preventing release of ink from said ink chambers unless pressure on a writing tip of said writing instrument exceeds a predetermined threshold.

18. The method of claim 16, further comprising transferring said output ink to a writing surface with a transfer member.

19. The method of claim 16, further comprising:

sensing an amount of ink in said mixing chamber; and controlling release of ink from said ink chambers in accordance with said sensing to ensure optimal flow of said output ink.

20. The method of claim 16, further comprising specifying said output color through a color input interface of said writing instrument.

21. The method of claim 16, further comprising resetting said output color to a default color.

22. The method of claim 16, further comprising specifying said output color by sampling a color with an optical scanner and matching said output color to said sampled color.

23. The method of claim 16, wherein said color input interface comprises a host electronic device.

24. A hand-held writing instrument for writing in a user-controlled color, said writing instrument comprising:

an ink cartridge comprising a plurality of ink chambers, each chamber for holding a different color ink;

means for mixing ink from said three ink chambers in a controlled ratio to produce an output ink of a target color, said means for mixing comprising a mixing chamber;

wherein said ink cartridge and means for mixing are incorporated into an elongated housing of said hand-held writing instrument; and a color input interface through which a user can specify an output color for said writing instrument, said output color being created by mixing ink from said ink chambers in said controlled ratio;

wherein said color input interface comprises three buttons, each button corresponding to one of the ink chambers and a color of ink contained therein.

25. The writing instrument of claim 24, further comprising means for transferring said output ink to a writing surface.

26. The writing instrument of claim 24, further comprising means for sampling a color with an optical scanner and matching said target color to said sampled color.

27. The writing instrument of claim 24, further comprising means for receiving data defining said target color from a host electronic device.

28. The writing instrument of claim 24, further comprising means for preventing release of ink from said ink chambers unless pressure above a predetermined threshold is applied to a writing tip of said writing instrument.

29. The writing instrument of claim 24, further comprising means for sensing an amount of ink in said mixing chamber.

30. A hand-held writing instrument for writing in a user-controlled color, said writing instrument comprising:

an ink cartridge comprising a plurality of ink chambers, each chamber for holding a different color ink;

nozzles connected to said ink chambers for releasing ink from said chambers in a controlled ratio; and a user interface comprising three buttons each of which corresponds to a color of ink in said ink cartridge, wherein said three buttons are operated to control said ratio of ink released from said chambers.

31. The writing instrument of claim 30, further comprising a pressure-sensitive tip on said writing instrument, said pressure-sensitive tip controlling said nozzles to prevent release of ink unless pressure on said tip is above a predetermined threshold.

32. The writing instrument of claim 30, further comprising a transfer member for receiving ink from said nozzles and transferring said ink to a writing surface.

33. The writing instrument of claim 30, further comprising a mixing chamber connected to said nozzles for receiving ink from said nozzles.

34. The writing instrument of claim 33, further comprising a sensor for sensing ink in said mixing chamber and outputting a signal indicative of an amount of ink in said mixing chamber.

35. The writing instrument of claim 30, further comprising a reset, connected to said processor, for resetting said controlled ratio to a default ratio.

36. A hand-held writing instrument for writing in a user-controlled color, said writing instrument comprising:

an ink cartridge comprising a plurality of ink chambers, each chamber for holding a different color ink;

nozzles connected to said ink chambers for releasing ink from said chambers in a controlled ratio; and a user interface for controlling said ratio of ink released from said chambers and a color of ink produced by said writing instrument, said user interface further comprising a reset button that, when activated, returns said ratio to a default ratio.

37. The writing instrument of claim 36, further comprising a pressure-sensitive tip on said writing instrument, said pressure-sensitive tip controlling said nozzles to prevent release of ink unless pressure on said tip is above a predetermined threshold.

38. The writing instrument of claim 36, further comprising a transfer member for receiving ink from said nozzles and transferring said ink to a writing surface.

39. The writing instrument of claim 36, further comprising a mixing chamber connected to said nozzles for receiving ink from said nozzles.

40. The writing instrument of claim 39, further comprising a sensor for sensing ink in said mixing chamber and outputting a signal to said processor indicative of an amount of ink in said mixing chamber.

41. The writing instrument of claim 39, wherein said user interface further comprises a color input interface through which a user can specify an output color for said writing instrument, said output color being created by mixing ink from said ink chambers in said controlled ratio.

42. The writing instrument of claim 41, wherein said color input interface comprises three buttons, each button corresponding to one of said ink chambers and a color of ink contained therein.

43. A hand-held writing instrument for writing in a user-controlled color, said writing instrument comprising:

an ink cartridge comprising a plurality of ink chambers, each chamber for holding a different color ink;

nozzles connected to said ink chambers for releasing ink from said chambers in a controlled ratio;

a mixing chamber connected to said nozzles for receiving ink from said nozzles; and a processor operatively connected to said nozzles for controlling the release of ink through said nozzles;

wherein said ink cartridge, nozzles and processor are all incorporated into an elongated housing of said hand-held writing instrument further comprising a display displaying numeric values indicating said controlled ratio of said different color inks being mixed in said mixing chamber.

* * * * *